United States Patent [19]

Madden

[11] Patent Number: 4,969,767

[45] Date of Patent: Nov. 13, 1990

[54] MULTICOLOR SURFACE STRIPING DEVICE

[75] Inventor: Patrick J. Madden, Pennant Hills, Australia

[73] Assignee: Colgate-Palmolive Company, New York, N.Y.

[21] Appl. No.: 249,739

[22] Filed: Sep. 26, 1988

[51] Int. Cl.[5] ..... A47L 13/32; B43K 5/00

[52] U.S. Cl. ..... 401/261; 401/263; 222/94

[58] Field of Search ..... 222/92, 94, 96, 129, 222/136, 137, 145, 330, 331, 488, 564; 424/49, 52; 206/219; 137/602; 401/261, 263

[56] References Cited

U.S. PATENT DOCUMENTS

| | | | |
|---|---|---|---|
| 2,789,731 | 4/1957 | Marraffino | 222/129 |
| 2,873,887 | 2/1959 | Spero | 222/94 |
| 2,905,364 | 9/1959 | Marraffino | 222/94 |
| 2,914,220 | 11/1959 | Marraffino | 222/145 |
| 3,002,658 | 10/1961 | Sajda | 222/94 |
| 3,135,428 | 6/1964 | Gallo, Sr. | 222/94 |

*Primary Examiner*—V. Millin
*Assistant Examiner*—D. F. Crosby
*Attorney, Agent, or Firm*—Norman Blumenkopf; Robert C. Sullivan; Murray M. Grill

[57] ABSTRACT

A striping device for forming a plurality of surface strips of two different colored materials on a base material. The striping device includes an inserted filled in a squeezable tube which has an outlet. The insert includes a central cylinder having a conical portion integral therewith for forming a first space between the conical portion and the tube and a second space between the conical portion and the central cylinder. The spaces are filled with differently colored striping material. Openings are provided communicating the first space with the central cylinder and passageways are provided communicating the second space with the central cylinder. The central cylinder is provided with grooves for guiding the striping material.

9 Claims, 4 Drawing Sheets

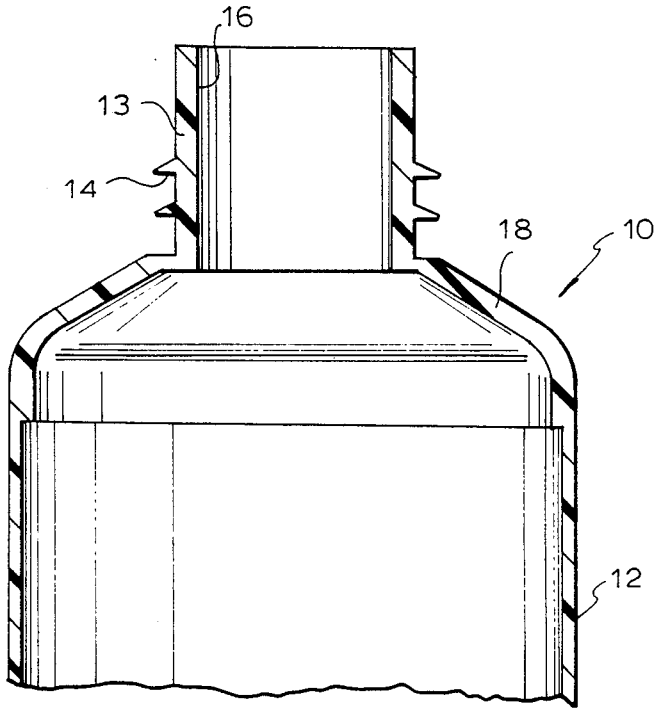
FIG. 1
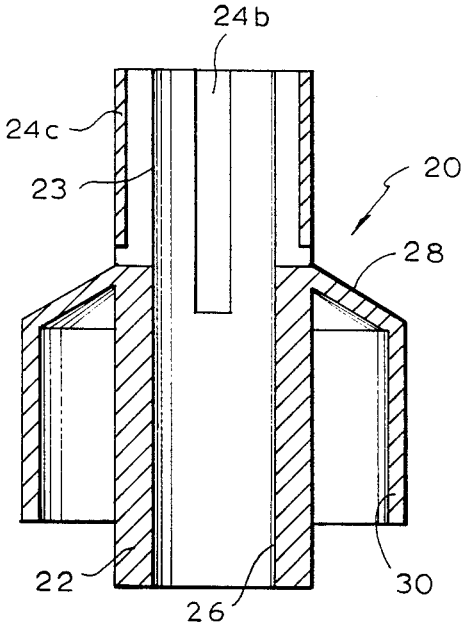

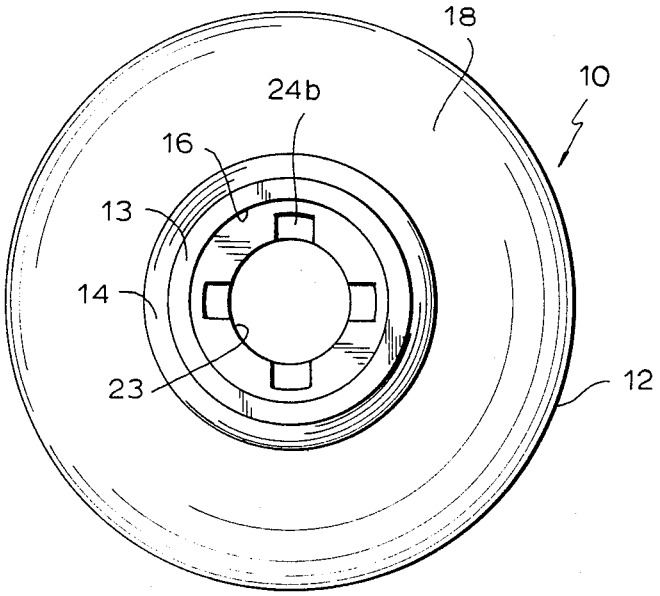
FIG. 4
FIG. 5
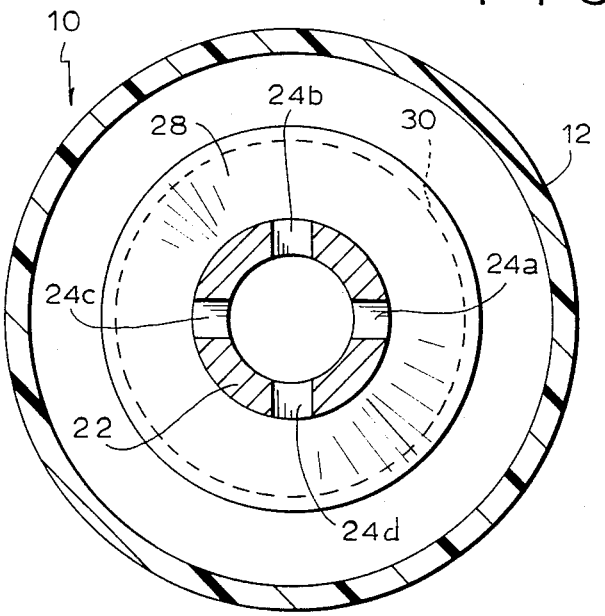

MULTICOLOR SURFACE STRIPING DEVICE

BACKGROUND OF THE INVENTION

1. Field of the Invention

This invention relates to a striping device and, more particularly, to a surface striping device adapted to produce two different colored stripes on a base paste material.

2. Description of the Prior Art

Various devices for producing stripes on paste or paste-like material have been developed. Primarily, the striped paste-like material is achieved by extruding two or more differently colored paste materials through a single orifice so that the striped material extends throughout the entire extruded mass of material and is not surface striped. Further, the striping generally assumes a spiral pattern. To achieve these results, larger amounts of coloring materials or dyes must be employed as compared to surface striping. Additionally, to simultaneously extrude two or more materials, greater pressure must be employed rendering the product more difficult to use than with a single base material or a surface striped material.

A surface striping device known in the art as the "Marraffino" striping device has been employed, but can achieve only one color stripe.

OBJECTS OF THE INVENTION

It is, therefore, the primary object of the present invention to provide a surface striping device capable of achieving two different colored surface stripes.

It is a further object of the invention to provide a striping device which achieves two different colored stripes on a base material requiring only a small amount of colored material.

Another important object of this invention resides in the provision of a striping device which is made of a single unitary member.

SUMMARY OF THE INVENTION

The present invention envisions a striping device made from a single unitary member adapted to be inserted into a collapsible tube. The striping device includes a central cylinder having a conical portion integral therewith which is adapted to lie against the shoulder of the tube. The space between the conical member and the tube is filled with a first colored striping material. A second differently colored striping material is disposed in the space between said cylindrical portion and a central cylinder. A pair of openings communicates the space between the first space and the central cylinder and a pair of passageways are provided communicating the second space and the central cylinder. The central cylinder is provided with grooves for guiding the striping material to form longitudinal stripes on the base material.

BRIEF DESCRIPTION OF THE DRAWINGS

FIG. 1 is an exploded sectional view of the striping device;

FIG. 4 is a top plan view of the striping device; and,

FIG. 5 is a horizontal sectional view taken along the plane of line 5—5 in FIG. 2.

DETAILED DESCRIPTION OF THE INVENTION

Figure 2:
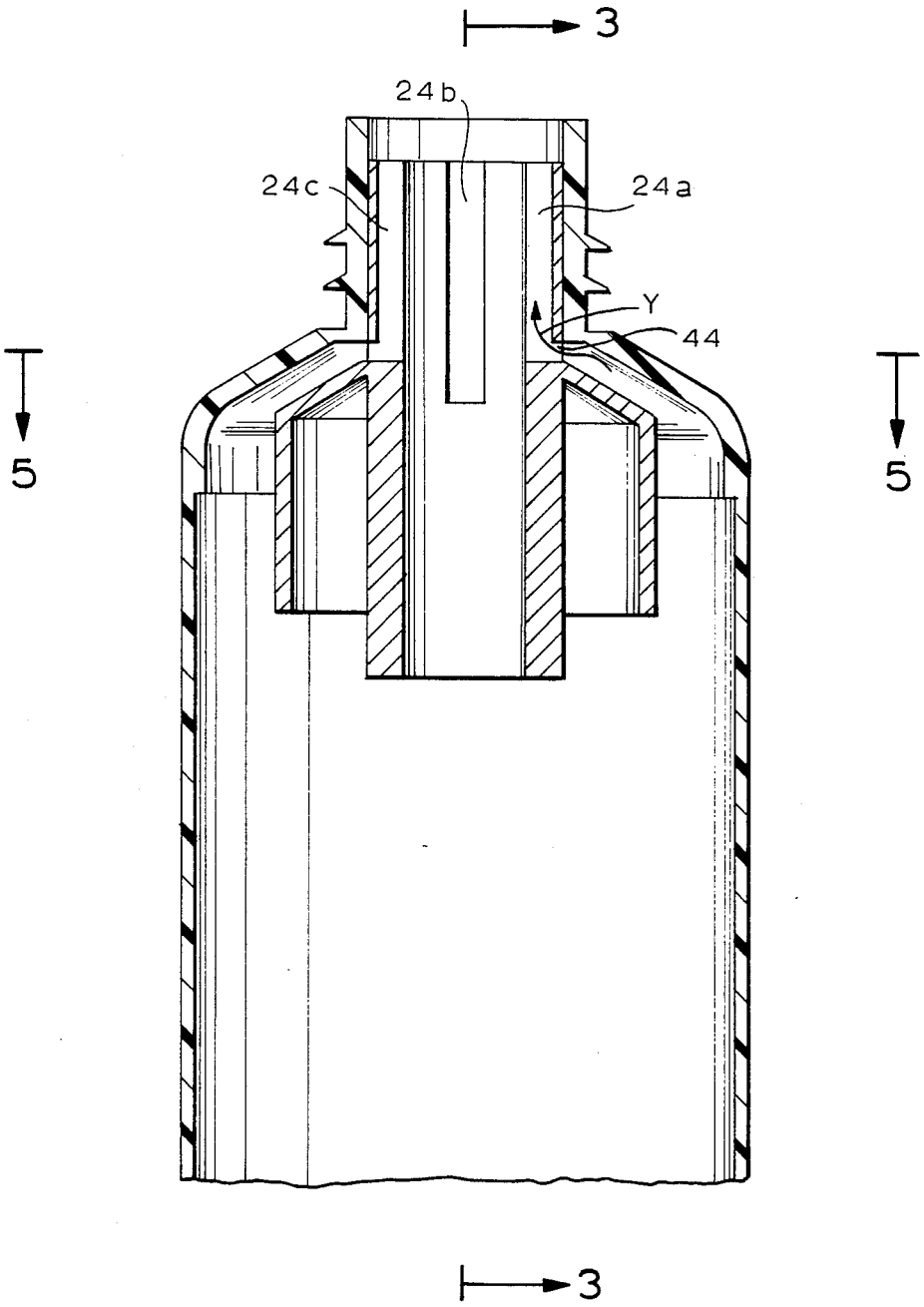
FIG. 2 is a vertical sectional detail view of the striping device in assembled condition.
Figure 3:
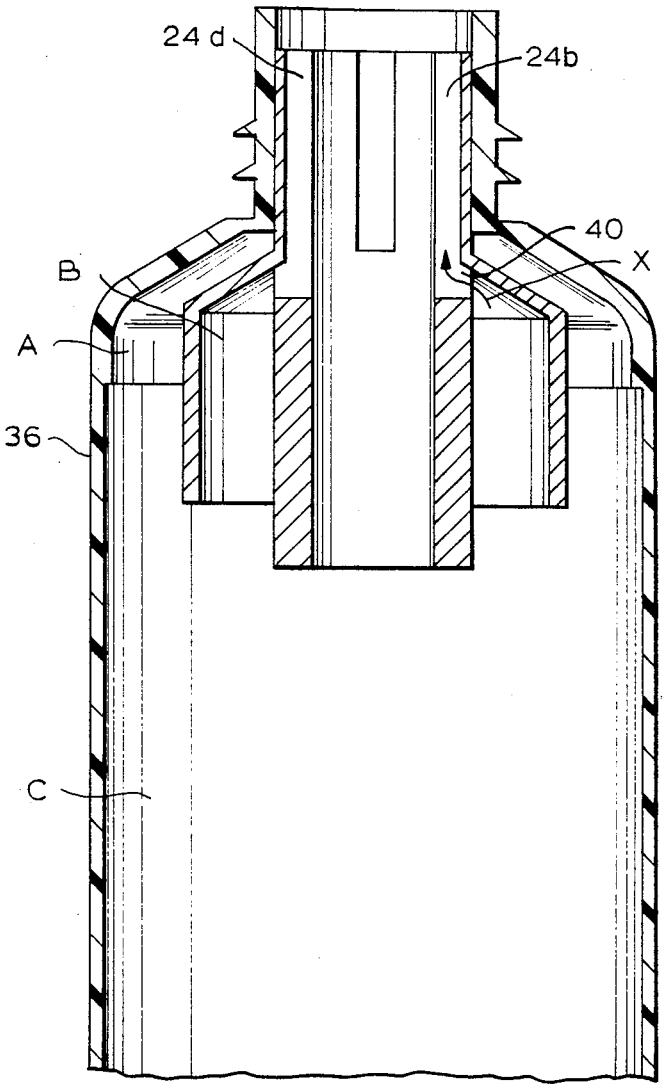
FIG. 3 is a vertical sectional view taken along the plane of line 3—3 in FIG. 2.

With continuing reference to the accompanying drawings, wherein like reference numerals designate similar parts throughout the various views, reference numeral 10 generally designates a collapsible tube made of metal or plastic. The tube 10 is adapted to be filled with paste or paste-like materials, such as cosmetics, including toothpaste or foodstuffs, such as decorative frostings, prepared foods for hors d'oeuvres, and the like.

The tube 10 has an elongated squeezable and deformable body 12, which is open at its bottom end until the tube 10 is filled. Thereafter it is crimped, heat sealed, sonic welded or otherwise closed at its bottom. The tube 10 is provided with a neck 13 which has external threading 14 adapted to receive a cap thereon for closing. The neck 13 is provided with an outlet bore 16 through which the paste material contained in the tube may be forced. Interconnecting the neck 13 with the body 12 is a tapered conical shoulder portion 18.

In accordance with the concepts of the present invention, the striping device is achieved by the employment of a single unitary and integral insert generally indicated at 20 and made of plastic or metal, but preferably made from a suitable synthetic plastic material. The insert 20 includes a central cylinder 22 having an upper portion 23 adapted to extend into the neck 13 of the tube 10. The upper portion 23 is provided with four grooves *24a, 24b, 24c, 24d* extending inwardly from the central bore 26 of the central cylinder 22.

Integrally connected to the central cylinder 22 is a downwardly tapered truncated conical portion 28 to which a cylindrical flange 30 is integrally appended.

The tube 10 is adapted to be filled with three differently colored paste materials. In the space marked "A" defined by the shoulder 18 of the tube, the upper tube wall 36 and the flange 30, there is disposed a first paste material having a first color.

A second colored paste material is disposed in the space marked "B," which is defined by the inner surface of the flange 30, the outer surface of the central cylinder 22 and the inner surface of the truncated conical portion 28. The interior of the tube 10 not occupied by spaces "A" and "B" forms space "C" having a basic paste material filled therein.

The truncated conical portion 28 is spaced from the shoulder portion 18 permitting paste material from space "A" to pass through a pair of openings 40 forming aperture means to direct the paste material from space "A" to be directed by grooves *24b* and *24d* which are provided. Other aperture means in the form of passageways 44 are formed. This permits passage of paste material from the space marked "B" through passageways 44 to grooves *24a* and *24c* for longitudinally guiding such colored paste material.

It is to be noted that the sizing of the central cylinder is such as to prevent the truncated conical portion 28 from abutting the shoulder 18.

After spaces "A" and "B" have been filled and the main tube space "C" has been filled, the bottom end of the tube is sealed and the striping device is ready for use. Squeezing of the tube 10 will force paste material in space "C" upwardly filling the central cylinder 22 and extending paste material through the tube outlet bore 16. Simultaneously, paste material in space "A" is forced through in the direction of arrow "X" into guiding grooves 24b and 24d to form longitudinally extending surface stripes on the base paste material. Also, at the same time, material from space "B" is forced through passageways 44 into grooves 24a and 24c to form two other longitudinally extending surface stripes of contrasting color from the first two recited longitudinal surface stripes and from the base paste material.

It is to be noted that the two pairs of surface stripes use far less coloring paste material than does striping wherein the differently colored paste materials do not include just surface stripes but extend throughout the thickness of the extruded material.

What is claimed is:

1. A multicolor surface striping device for a tube having an outlet, an insert in said tube having a central cylinder in alignment with said outlet, said insert including a cone defining a first space between said insert and said tube for receiving a first striping colored material, a second space between said cone and said central cylinder for receiving a second striping material, and a main product space within said tube and extending into said central cylinder, said insert having aperture means communicating said spaces with said central cylinder, said central cylinder having an inner surface with axially extending grooves therein communicating with said apertures means so that pressure on said tube forces the main product material and both said striping materials through said outlet with said grooves directing said second and third materials to form stripes on said first material.

2. A multicolor surface striping device according to claim 1, wherein said aperture means includes openings communicating said second space and said central cylinder.

3. A multicolor surface striping device according to claim 1, wherein said aperture means includes passageways communicating said first space and said central cylinder.

4. A multicolor surface striping device according to claim 1, wherein said aperture means includes openings communicating said second space and said central cylinder and passageways communicating said first space and said central cylinder..

5. A multicolor surface striping device according to claim 1, wherein said tube has a conical shoulder portion said conical portion being spaced from said shoulder.

6. A multicolor surface striping device according to claim 1, wherein said aperture means includes openings communicating said second space and said central cylinder, there being a pair of said openings in opposed relationship so that two opposed longitudinal stripes of said first striping material will pass through said outlet.

7. A multicolor surface striping device according to claim 1, wherein said aperture means includes passageways communicating said first space and said central cylinder, there being two opposed passageways for forming two opposed stripes of said second striping material.

8. A multicolor surface striping device according to claim 1, wherein said central cylinder is provided with groove means for guiding said striping materials.

9. A multicolor surface striping device according to claim 1, wherein there are four grooves, two grooves guiding one striping material, while two other grooves guide the other striping material.

* * * * *